US012114687B2

(12) United States Patent
Plattner et al.

(10) Patent No.: US 12,114,687 B2
(45) Date of Patent: Oct. 15, 2024

(54) TOBACCO MOUSSE

(71) Applicant: JT International SA, Geneva (CH)

(72) Inventors: Michael Plattner, Trier (DE); Takashi Hasegawa, Tokyo (JP)

(73) Assignee: JT International S.A. (CH)

( * ) Notice: Subject to any disclaimer, the term of this patent is extended or adjusted under 35 U.S.C. 154(b) by 153 days.

(21) Appl. No.: 17/886,984

(22) Filed: Aug. 12, 2022

(65) Prior Publication Data

US 2022/0378086 A1 Dec. 1, 2022

Related U.S. Application Data

(63) Continuation of application No. 16/474,417, filed as application No. PCT/EP2017/084812 on Dec. 29, 2017, now Pat. No. 11,412,774.

(30) Foreign Application Priority Data

Dec. 29, 2016 (EP) ..... 16207283

(51) Int. Cl.

| | |
|---|---|
| ***A24B 15/16*** | (2020.01) |
| ***A24B 15/167*** | (2020.01) |
| *A24F 40/20* | (2020.01) |
| *A24F 40/465* | (2020.01) |

(52) U.S. Cl.

CPC ..... *A24B 15/16* (2013.01); *A24B 15/167* (2016.11); *A24F 40/20* (2020.01); *A24F 40/465* (2020.01)

(58) Field of Classification Search

None

See application file for complete search history.

(56) References Cited

U.S. PATENT DOCUMENTS 3,364,935 A * 1/1968 Germino ..... A24B 3/14 131/370
3,404,690 A * 10/1968 Moshy ..... A24B 15/12 131/355
3,404,691 A * 10/1968 Moshy ..... A24B 15/12 131/355

(Continued)

FOREIGN PATENT DOCUMENTS

AU 721146 B2 6/2000
WO 2014083333 A1 6/2014

OTHER PUBLICATIONS

Definition of kit, Merriam-Webster Dictionary, no date, [online], retrieved from the Internet, [retrieved Aug. 27, 2021], <URL: https:// www .merriam-webster.com/dictionary/kit> (Year: 2021).

(Continued)

*Primary Examiner* — Dennis R Cordray
(74) *Attorney, Agent, or Firm* — Lerner David LLP

(57) ABSTRACT

A foam includes a tobacco ingredient containing agent and/or an inhalable agent, an aerosol forming agent, a foam stabilizing agent, and a foam forming agent. In one embodiment, a weight of the tobacco ingredient containing agent and/or the inhalable agent is 0.1-33 wt.-% of a weight of the foam, and a weight of the aerosol forming agent is 10-80 wt. % of the weight of the foam. In another embodiment, the foam forming agent is a non-protein contain polysaccharide and a weight of the foam forming agent is less than 20 wt.-% of the foam.

7 Claims, 8 Drawing Sheets

(56) References Cited

U.S. PATENT DOCUMENTS

| | | | | |
|---|---|---|---|---|
| 3,410,279 | A * | 11/1968 | Moshy | A24B 15/12 131/355 |
| 4,002,178 | A | 1/1977 | Fiore et al. | |
| 4,510,950 | A | 4/1985 | Keritsis et al. | |
| 5,249,586 | A | 10/1993 | Morgan et al. | |
| 7,500,485 | B1 | 3/2009 | Shepard et al. | |
| 2011/0088708 | A1 | 4/2011 | John et al. | |
| 2016/0286851 | A1 | 10/2016 | Hufnagel et al. | |

OTHER PUBLICATIONS

International Search Report and Written Opinion for PCT/EP2017/084812, mailed Apr. 12, 2018.

* cited by examiner

TOBACCO MOUSSE

CROSS-REFERENCE TO RELATED APPLICATIONS

The present application is a continuation of U.S. patent application Ser. No. 16/474,417, filed on Jun. 27, 2019, which is a national phase entry under 35 U.S.C. § 371 of International Application No. PCT/EP2017/084812, filed Dec. 29, 2017, published in English, which claims priority to European Patent Application No. 16207283.9 filed Dec. 29, 2016, the disclosures of which are incorporated herein by reference.

SUMMARY

The present invention relates to a foam, comprising a tobacco ingredient containing agent and/or an inhalable agent, an aerosol forming agent, a foam stabilizing agent, and a foam forming agent.

BACKGROUND ART

Foamed tobacco products have been known in the prior art mainly in the field of reconstituted tobacco products. Manufacturing processes usually involve forming reconstituted tobacco sheets out of finely ground tobacco particles with a foam forming and a foam stabilizing agent, followed by shredding the reconstituted sheets, and blending with natural tobacco shreds. The reconstituted tobacco products are usually used for the manufacture of cigarettes.

For example, tobacco foams are used for producing reconstituted tobacco, as disclosed in e.g. U.S. Pat. No. 4,002,178 A, wherein the precursors glycerine and propylene glycol are used in an amount of less than 5%, and tobacco in about 70%. U.S. Pat. No. 7,500,485B1 describes a foamed tobacco composition wherein the amount of tobacco is about 40 wt.-%.

However, these foams are intended for use by combustion as a replacement for tobacco using reconstituted tobacco.

Further, foams comprising tobacco that are used for combustion, i.e. burning, are disclosed in U.S. Pat. No. 7,500,485 B1, US 2016/286851 A1 and US 2011/088708 A1.

U.S. Pat. No. 7,500,485 B1 relates to a foamed tobacco composition which includes tobacco particles, water and a foam stabilizer which is a hydrophobically modified hydroxyalkylated carbohydrate, as well as the use thereof in a low density tobacco sheet material, which then can be used to produce filler material in cigars, cigarettes or pipes.

In US 2016/286851 A1 a smoking composition comprising an aerosol-forming substrate and a flavor precursor compound is disclosed.

US 2011/088708 A1 describes smokable filler materials and a process for making same, wherein the smokable filler material comprises a foaming agent, an agent capable of forming chemical cross-linkages, and a cross-linking agent.

The spread and popularity of electronic cigarettes (e-cigarettes) came with the need and possibility for novel tobacco products to be vaporized and inhaled by smokers. E-cigarettes or similar devices like electronic pipes usually generate an aerosol by heating a liquid comprising an aerosol forming agent, water, and optionally additional flavoring and nicotine. Overall, this can lead to an uneven smoking profile, wherein the experienced flavor of puffs can differ significantly, e.g. by an inefficient extraction of key compounds in the liquid.

The problem of the present invention is to provide a product that can provide a more homogeneous evaporation profile, thereby providing a smoker with an even smoking profile.

BRIEF DESCRIPTION OF THE INVENTION

The inventors have found that an aerosol containing a tobacco ingredient containing agent and/or an inhalable agent can be more homogeneously released from a foam wherein an aerosol forming agent is contained.

A first aspect of the present invention relates to a foam comprising a tobacco ingredient containing agent and/or an inhalable agent, an aerosol forming agent, a foam stabilizing agent, and a foam forming agent, wherein the weight of the tobacco ingredient containing agent and/or the inhalable agent is 0.1-33 wt.-% of the weight of the foam, and the weight of the aerosol forming agent is 10-70 wt.-% of the weight of the foam. Further disclosed is in a second aspect a foam essentially consisting of a tobacco ingredient containing agent and/or an inhalable agent, an aerosol forming agent, a foam stabilizing agent, and a foam forming agent. According to certain embodiments, the foam consists of a tobacco ingredient containing agent and/or an inhalable agent, an aerosol forming agent, a foam stabilizing agent, and a foam forming agent, and unavoidable impurities. Also disclosed is in a third aspect a foam comprising: a tobacco ingredient containing agent and/or an inhalable agent, an aerosol forming agent, a foam stabilizing agent, and a foam forming agent, wherein the foam forming agent is preferably a non-protein contain polysaccharide, and wherein the weight of the foam forming agent is less than 20 wt.-% of the foam. More preferably the weight of the foam forming agent is less than 10 wt.-% and most preferably the weight of the foam forming agent is less than 5 wt.-% of the foam.

In another aspect of the present invention a method of generating an aerosol is disclosed, the method comprising heating a foam comprising a tobacco flavor containing agent, an aerosol forming agent, a foam stabilizing agent, and a foam forming agent, particularly the foam according to the first and/or second and/or third aspect of the present invention, in the absence of combustion at 150-350° C.

Further provided is a method of forming a foam, comprising, mixing an aerosol forming agent, a foam forming agent, and optionally a solvent, under heating, optionally injecting a gas, adding to the mixture a tobacco ingredient containing agent and/or an inhalable agent, adding a foam stabilizing agent, and cooling of the mixture.

Also disclosed is a method of forming a foam, comprising mixing an aerosol forming agent and optionally a solvent, under heating; adding to the mixture a tobacco ingredient containing agent and/or an inhalable agent; adding a foam forming agent; optionally injecting a gas; adding a foam stabilizing agent; and cooling of the mixture.

Particularly, the foams of the first and second and third aspect of the invention can be formed with the present methods.

Another aspect of the present invention relates to a method of supplying a foam to an aerosol generation apparatus, the method comprising: removably providing a foam to a receiving portion of the apparatus, the receiving portion operatively connected to a heat transfer system for generation of an aerosol from said foam.

Disclosed is also a kit for supplying a tobacco ingredient containing agent and/or an inhalable agent containing foam, comprising a foam comprising a foam stabilizing agent, a foam forming agent, and optionally a first aerosol forming agent; and a mixture containing a tobacco ingredient containing agent and/or an inhalable agent, and a second aerosol forming agent, wherein the weight of the tobacco ingredient containing agent and/or the inhalable agent is 0.1-33 wt.-% of the weight of the foam and the mixture, and the total weight of the first and second aerosol forming agent in the kit is 10-80 wt. %, preferably 40-70 wt.-%, of the weight of the foam and the mixture.

Even further the present invention refers to a foam comprising a foam stabilizing agent, a foam forming agent, and an aerosol forming agent, wherein the weight of the aerosol forming agent in the foam is 10-80 wt. %, preferably 40-70 wt.-%, of the weight of the foam.

Also disclosed is a packaging containing a foam of the present invention, i.e. of the first to third aspect and of the aspect discussed before, i.e comprising a foam stabilizing agent, a foam forming agent, and an aerosol forming agent, wherein the weight of the aerosol forming agent in the foam is 10-80 wt. %, preferably 40-70 wt.-%, of the weight of the foam.

Further aspects and embodiments of the invention are disclosed in the dependent claims and can be taken from the following description and examples, without being limited thereto.

FIGURES

The enclosed drawing should illustrate embodiments of the present invention and convey a further understanding thereof. In connection with the description it serves as explanation of concepts and principles of the invention. Other embodiments and many of the stated advantages can be derived in relation to the drawing.

DETAILED DESCRIPTION OF THE INVENTION

Definitions

Figure 1:
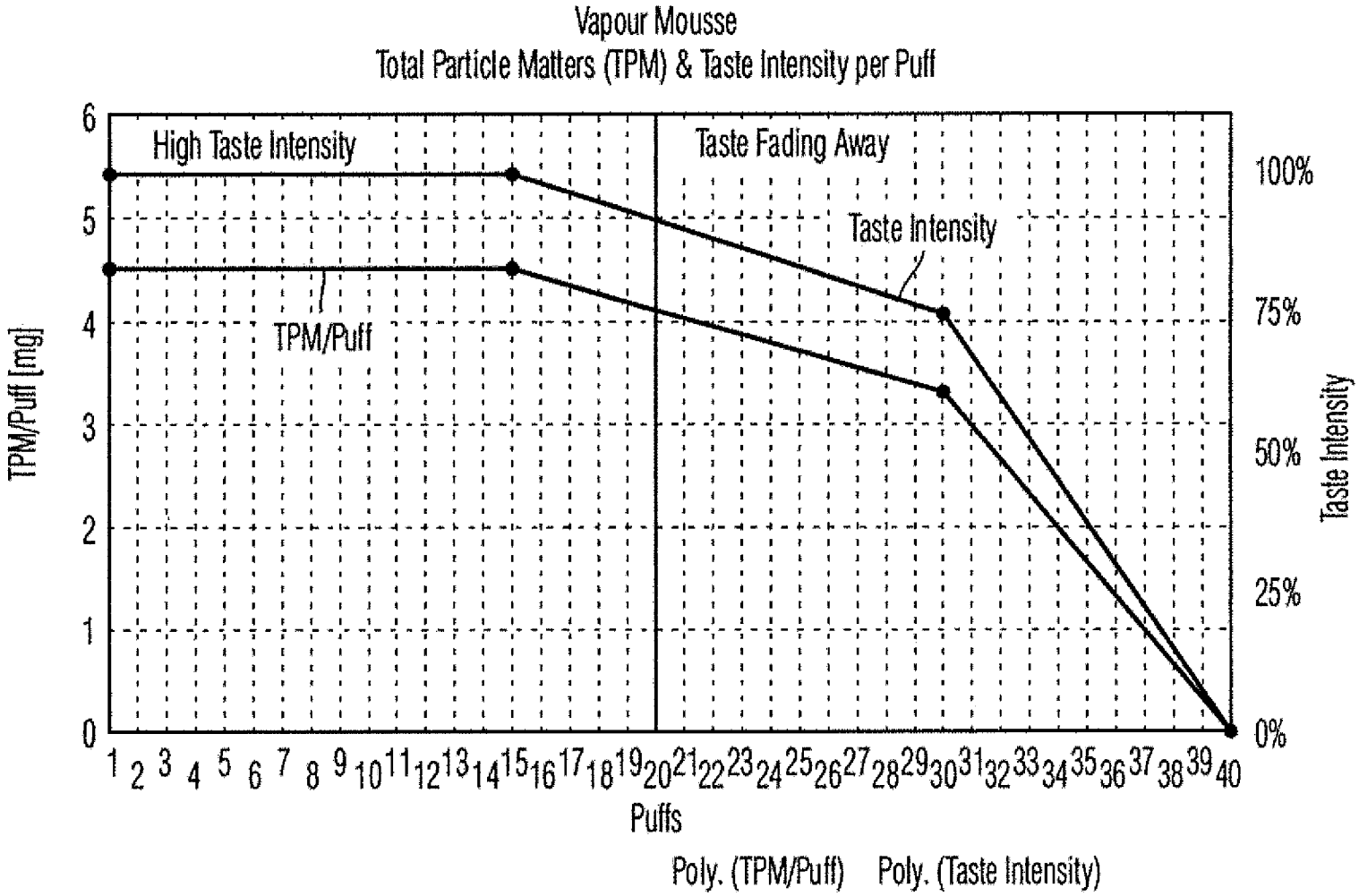
FIG. 1 shows a smoking profile of a tobacco mousse comprising the present foam.

Unless defined otherwise, technical and scientific terms used herein have the same meaning as commonly understood by one of ordinary skill in the art to which this invention belongs.

All values given in the present disclosure are to be understood to be complemented by the word "about", unless it is clear to the contrary from the context.

An open pored foam as used herein is to be understood as a foam, wherein the gas pockets in the foam connect with each other, contrary to a closed-cell foam, wherein the gas is in discrete pockets, each completely enclosed by a foam material.

A tobacco ingredient containing agent can be any compound, mixture, particle matter, and/or solution that contains and/or carries a constituent of tobacco, either artificially included or naturally contained in tobacco, e.g. tobacco, tobacco particles, tobacco flavor and/or nicotine. In contrast, an example for an artificially added non-tobacco-specific flavor would be menthol.

An inhalable agent can be any compound, mixture, particle matter and/or solution that may be inhaled, for example as a gas and/or aerosol, and it e.g. includes and/or carries at least one of a stimulant, e.g. caffeine, guarana and combinations thereof, and/or a flavor, e.g. menthol, natural and/or artificial plant flavors, saccharides, animal flavors, and combinations thereof. The inhalable agents can be included to have the same approximate proportion with the aerosol forming agent as found in conventional e-liquids well known to persons skilled in the art.

An aerosol forming agent can be any compound, mixture and/or solution that is capable of forming an aerosol, e.g. when heated and/or in mixture with a tobacco ingredient containing agent and/or an inhalable agent.

An aerosol generation apparatus within the present invention is not particularly limited, and is used to generate an aerosol. It can comprise, for example, an electronic cigarette (e-cigarette) or similar devices, like electronic pipes.

An electronic cigarette (e-cigarette) or similar devices like electronic pipes, as referred to in the present invention, are not particularly limited, and may be used to provide a user with an aerosol to inhale. It can, according to certain embodiments, comprise a mouthpiece, a heater, a receiving portion, e.g. a pod, and a casing.

A pod is not particularly limited and can be a storage device into which the present foam can be, e.g. removably, inserted. It can for example be in cylindrical, conical, stick and/or cuboid form, but is not limited to such shapes.

An induction heating system as referred to in the present invention and mentioned as an example of a heater is not particularly limited and may be any system which uses electromagnetic induction created by a coil positioned around an electrically conducting material, and more particularly a ferromagnetic material, to generate heat.

As used herein, wt.-% is to be understood as weight percent, based on the total weight of the foam, unless explicitly otherwise specified. In the present disclosure, all amounts are given in wt.-%, unless clearly stated otherwise or obvious from context. In the present disclosure, furthermore all amounts given in wt.-% in a particular foam add up to 100 wt.-%. The weight percent are thereby calculated by dividing the mass of each component by the total mass of the foam, unless indicated otherwise or clear from context.

Particle sizes, as disclosed in this invention, can be measured by any suitable method, e.g. sieving or laser diffraction, preferably sieving.

The present invention relates to a foam comprising: a tobacco ingredient containing agent and/or an inhalable agent, an aerosol forming agent, a foam stabilizing agent, and a foam forming agent, wherein the weight of the tobacco ingredient containing agent and/or the inhalable agent is 0.1-33 wt.-% of the weight of the foam, and the weight of the aerosol forming agent is 10-80 wt.-%, preferably 40-70 wt.-%, particularly preferably 45-65 wt.-%, of the weight of the foam.

According to certain embodiments, the balance to 100 wt.-% of the weight of the foam is essentially foam stabilizing agent and foam forming agent. Small amounts of water and/or acid and/or ester, e.g. diacetin, up to 15 wt.-%, preferably up to 5 wt.-%, further preferably up to 3.5 wt.-%, even further preferably up to 2.5 wt.-%, more preferably up to 1.5 wt.-%, and most preferably between 0.5-1.5 wt.-%, at least between 0.5-1.5 wt.-% water, can be contained in the foam according to certain embodiments. According to certain embodiments, no water and/or acid and/or ester, e.g. diacetin, or at least less than 1 wt.-%, is contained in the present foam. In burning applications, e.g. smoking articles, normally water is contained in higher amounts as dry smoke does not taste so good. In contrast, the present foams are particularly not combusted and the aerosol forming agent can carry aromas and/or flavors, so that the amount of water can be kept low, although some small amounts of water may help to reduce any harshness in the vapour and give rise to a milder smoking experience. Similarly, the addition of a small amount of diacetin (preferably less than 1 wt.-%) may also reduce any harshness in the produced aerosol as experienced by users.

Further disclosed is in a second aspect a foam consisting essentially of a tobacco ingredient containing agent and/or an inhalable agent, an aerosol forming agent, a foam stabilizing agent, and a foam forming agent. Small amounts of water and/or acid and/or ester, e.g. diacetin, up to 5 wt.-%, preferably up to 3.5 wt.-%, further preferably up to 2.5 wt.-%, even further preferably up to 1.5 wt.-%, can be contained in the foam according to the second aspect of the invention.

According to certain embodiments, the foam can consist of a tobacco ingredient containing agent and/or an inhalable agent, an aerosol forming agent, a foam stabilizing agent, and a foam forming agent. In such embodiment, of course unavoidable impurities can be contained.

A third aspect of the invention relates to a foam comprising: a tobacco ingredient containing agent and/or an inhalable agent, an aerosol forming agent, a foam stabilizing agent, and a foam forming agent, wherein the foam forming agent is a non-protein containing polysaccharide and the weight of the foam forming agent is less than 20 wt.-% of the foam. According to certain embodiments of the foam of the third aspect, the weight of the tobacco ingredient containing agent and/or the inhalable agent is 0.1-40 wt.-%, preferably 0.1-33 wt.-% of the weight of the foam, and/or the weight of the aerosol forming agent is 10-80 wt. %, preferably 40-70 wt.-%, of the weight of the foam.

The present foams, i.e. of the first, second and third aspect, can be—according to certain embodiments—configured to be heated but not combusted, i.e. are used in an application where it is not smoked. Thus, disclosed is also a use of the present foams as articles that are not combusted, and the use thereof in non-smoking applications, e.g. for evaporating devices like e-cigarettes, e-pipes and similar devices. The foams of the first, second and third aspect can be used in a vaporizer device comprising a heater for heating the foam to a temperature of at most 350° C., preferably at most 300° C., further preferably below 300° C. and most preferably between 220 C to 270 C.

In the following, the description relates to the foams of the first to third aspect, unless clear from context that it is otherwise.

The present foams preferably are not smokable, i.e. are applied in a way that they are not heated to such temperature where they are combusted, but only at least parts thereof are evaporated, particularly at least essentially the aerosol forming agent and further preferably at least a part of the tobacco ingredient containing agent and/or the inhalable agent, further preferably also essentially the tobacco ingredient containing agent and/or the inhalable agent. In the present foams, at least some parts of the tobacco ingredient containing agent and/or the inhalable agent preferably is adhered to the foam structure and/or absorbed by the foam structure formed essentially by the foam forming agent and the foam stabilizing agent, so that it can be easily released together with the aerosol forming agent upon heating. Also, it is possible that some parts of the tobacco ingredient containing agent and/or the inhalable agent are bound to the foam structure and the tobacco ingredient containing agent and/or the inhalable agent are "extracted" during heating thereof, so that a flavor from the tobacco ingredient containing agent and/or the inhalable agent is released thereof together with the aerosol forming agent. According to certain embodiments, the tobacco ingredient containing agent and/or the inhalable agent is configured in such a way that it is released upon heating together with the aerosol forming agent by only being essentially adsorbed to and/or absorbed in the foam structure. In this regard it was shown by the inventors that a mass loss in the foam can be observed that shows that essentially at least the mass of the foam forming agent and the foam stabilizing agent remains. It is assumed that the structure of the foam is mainly formed by the foam forming agent, which forms a "capsulation" for adhering and/or absorbing the aerosol forming agent and the tobacco ingredient containing agent and/or an inhalable agent, whereas the foam stabilizing agent stabilizes the foam to keep the foam form.

According to certain embodiments, only a small amount or essentially no amount, e.g. no amount, of the aerosol forming agent takes part in foam formation, i.e. is bound within the foam. The aerosol forming agent does preferably not form the foam structure and further preferably essentially is adhered to the foam structure and/or included in the foam structure, e.g. trapped in pores thereof at ambient temperature of e.g. 0 to 40° C., e.g. room temperature of about 20 to about 25° C.

Thus, according to certain embodiments, the present foams will experience a significant weight loss due to the aerosol forming agent at least upon heating to a temperature where the aerosol forming agent is evaporated, e.g. to a temperature that is at least as high as the highest boiling point of all aerosol forming agents contained, but preferably below a temperature at which the foam is combusted. Therefore, the invention also refers to a foam that is resulting from a heating of the foam of the first and/or second and/or third aspect, particularly to a temperature that is at least as high as the highest boiling point of all aerosol forming agents contained, but preferably below a temperature at which the foam is combusted, wherein particularly at least 40 wt.-%, preferably at least 45 wt.-%, further preferably at least 50 wt.-%, particularly preferably at least 60 wt.-% of the weight of the unheated foam is lost upon heating.

Also, the foams are—according to certain embodiments—not bound and/or connected to a carrier, i.e. can be used as is, i.e. as free-standing foam. Particularly, the foam are not bound to a substrate according to certain embodiments, but rather are used as is. Thus, according to certain embodiments, the present foams are stable enough to be used as is, i.e. are self-supporting, and have a sufficient stiffness so that they are not bent when picked up on their own and do not require a further stabilizing substrate.

According to certain embodiments, the present foams are biodegradable.

The following description relates to the above foams described in the first, second and third aspect of the invention, and thus applies to each of these. All present foams can be e.g. in the form of a mousse.

The foam structure in the foams is not particularly limited and can, for example, comprise trapped air bubbles and/or bubbles of other gases such as nitrogen or oxygen, e.g. air bubbles. It can be provided as an open structure with a large surface area, which enables heat and aerosol to circulate through the foam, particularly during heating, thus providing uniform heating, a good quality aerosol, and extremely efficient extraction of the tobacco ingredient containing agent and/or the inhalable agent. According to certain embodiments the foam is an open pored foam. It can be a liquid foam, a dry foam, a solid foam, or a pellet, preferably a dry foam, a solid foam or a pellet. The foam forming agent generally can trap the bubbles when the foam is formed, e.g. whipped, and the foam stabilizing agent can reduce and even prevent breakdown of the foam. The bubbles of the foam may have an average diameter in the range of 20-120 μm, e.g. 50-100 μm, e.g. 60-80 μm, and about 98% of the bubbles may have a diameter of 160 μm or less, e.g. 140 μm or less, e.g. 120 μm or less. The foam may be formed into any suitable shape for insertion into an e-cigarette. According to certain embodiments, the present foam comprises at least one blind or hole through the foam for circulation and aerosol transmission, e.g. one, two, three, four, five, six, seven, eight, nine, ten or more hole through the foam. An example shape is an annular pipe shape hole going through the foam portion of any shape, e.g. of about 1 cm diameter, e.g. a 3 mm through hole, or a square, a star, but can also be any other shape or dimension. According to certain embodiments, the foam is having a structure having a big surface area, e.g. having at least one surface with at least one distance between any two sides of the surface or with a diameter that is sufficiently larger than the thickness of the foam. The foam can thus be in the shape of a disc, e.g. a cylindrical disc, a thin plate, etc. According to certain embodiments the at least one hole is going through the at least one surface with at least one distance between any two sides of the surface or with a diameter that is sufficiently larger than the thickness of the foam.

The tobacco ingredient containing agent, e.g. tobacco, may be used to provide authentic flavor, and is not particularly limited. According to certain embodiments, the tobacco ingredient containing agent of the present foam is at least one selected from the group consisting of tobacco, tobacco flavor such as various tobacco extracts, and nicotine or a derivative thereof. The tobacco, tobacco flavor and/or nicotine may be derived from any part of the tobacco plant (seed, stem, leave and so on).

Similarly, the inhalable agent is not particularly limited, and may be e.g. at least one of a stimulant, e.g. caffeine, guarana, and combinations thereof, and/or a flavor, e.g. menthol, natural and/or artificial plant flavors, e.g. flavourings known for use in conventional e-liquids for use with e-liquid vapourising e-cigarettes, e.g. in the amounts used therein, saccharides, animal flavors, and combinations thereof The tobacco ingredient containing agent and/or the inhalable agent are preferably comprised in the present foam in an amount of 0.1 to 40 wt.-%, further preferably 0.1-33 wt.-% of the weight of the foam. If the amount of tobacco is increased above 40 wt. %, particularly above 33 wt.-% of the weight of the foam, for example at the expense of the stabilizing agent, the foam, e.g. in a mousse, may become too brittle and unstable. Also if the amount of the tobacco ingredient containing agent and/or the inhalable agent is increased above this amount, the amount of the aerosol forming agent may be reduced, which can cause a lower amount of aerosol TPM (total particle matter, which is the amount of aerosol matter retained in a filter per user inhale). In certain embodiments the amount of tobacco ingredient agent and/or inhalable agent comprised in the foam is 1-30 wt.-% of the weight of the foam, preferably 3-29 wt. %, further preferably 5-28 wt.-%, more preferably 10-28 wt. %, even further preferably 11 to 27.5 wt.-%, e.g. 15 to 25 wt.-%, e.g. 11-23 wt.-%, e.g. 17-21 wt.-%.

According to certain embodiments, the tobacco ingredient containing agent comprises tobacco particles having a particle size of less than 200 μm, preferably less than 150 μm, further preferably less than 100 μm, even further preferably less than 50 μm, even preferably less than 30 μm, e.g. 2-150 μm, e.g. 5-100 μm, e.g. 5-50 μm, e.g. 5-30 μm, e.g. 5-15 μm, e.g. 20-50 μm, e.g. 60-90 μm. The particle size can be measured through sieving, and the particles may be obtained through any suitable shredding and/or milling process. According to certain embodiments, the tobacco particles have essentially a uniform size, e.g. a uniform size.

However, it is also possible to add tobacco particles with different sizes in two or more fractions, e.g. a first fraction with particles having a size of less than 30 μm, e.g. less than 20 μm, and a second fraction with particles having a size of more than 30 μm, e.g. more than 50 μm, e.g. more than 100 μm, e.g. more than 200 μm. e.g. about 250 μm or more. Preferably, a, e.g. second, fraction of tobacco particles with a size of more than 30 μm is contained in a mixture of tobacco particles with different sizes in an amount of less than 90 wt.-%, preferably 80 wt.-%, or less, further preferably less than 50 wt.-%, even further preferably less than 40 wt.-%, even further preferably less than 30 wt.-%, even further preferably 20 wt.-% or less, based on the total weight of the tobacco particles. An addition of tobacco particles with a size of more than 30 μm can lead to a reduction in harshness of the aerosol liberated from the foam upon heating in the first puffs.

In the present method, the foam stabilizing agent is not particularly limited as long as it can stabilize the foam to some extent after formation. According to certain embodiments, the foam stabilizing agent of the present foam is selected from the group consisting of cellulose gum, hydroxyalkylated carbohydrates, derivatives thereof, e.g. salts thereof, preferably alkali metal salts thereof, e.g. sodium and/or potassium salts thereof, and mixtures thereof. Both of the cellulose gum and the hydroxyalkylated carbohydrates are not particularly restricted. According to certain, preferred, embodiments, the foam stabilizing agent is a cellulose gum, particularly a carboxymethylcellulose, or a derivative thereof. An exemplary, preferred, cellulose gum which may be used in the present invention is CEKOL® 2000, a purified sodium carboxymethylcellulose. Another class of suitable foam stabilizing agents are hydroxyalkylated carbohydrates, and more preferably cellulose ethers and derivatives thereof. A cellulose ether or derivative thereof that can be used can have at least one substituent selected from the group consisting of methyl, ethyl, hydroxyethyl and hydroxypropyl groups. It can further be substituted with a linear or branched substituted or unsubstituted alkyl radicals having 1-20 carbon atoms or an aralkyl radical having 7 to 20 carbon atoms. Such radical is preferably attached by an ether linkage. Suitable substituents can e.g. a hydroxy group, a carboxy group with 1 to 4 carbon atoms, etc. According to certain embodiments the cellulose ether is selected from hydroxyethylcellulose, methylcellulose, methylhydroxyethylcellulose, ethylhydroxyethylcellulose, and mixtures thereof. Furthermore, mixtures of different cellulose gums, different hydroxyalkylated carbohydrates, and mixtures of one or more cellulose gum with one or more hydroxyalkylated carbohydrate, as well as derivatives of one or either thereof, can be used. Also included as derivatives are salts of these cellulose ethers, preferably alkali metal salts thereof, e.g. sodium and/or potassium salts thereof.

The amount of the foam stabilizing agent in the foam is not particularly limited as long as a suitably stable foam can be formed. For example, the foam stabilizing agent can be contained in an amount of 3-60 wt.-%, preferably 4-50 wt.-%, more preferably 4-45 wt.-%, more preferably 4.2-40 wt.-%, further preferably 4.5-20 wt.-%, even further preferably 5-20 wt.-%, even further preferably 5.5-16 wt.-%, e.g. 8-40 wt.-%, e.g. 12-30 wt.-%, e.g. 16-20 wt.-%.

Also the foam forming agent is not particularly restricted. According to certain embodiments, the foam forming agent of the present foam is selected from the group consisting of agar, gellan gum, lecithin, polyglycerol esters of fatty acids, glycerol esters of fatty acids, sorbitan esters of fatty acids, and/or mixtures thereof, without being limited thereto. A preferred foam forming agent is gellan gum. It has been shown that particularly proteoglycans, but also pectin and alginates, are less suitable as foam forming agents. The fatty acids therein are not particularly limited and can comprise e.g. 8-40 carbon atoms. Glycerol esters can be prepared by standard esterification methods. If glycerol esters of fatty acids are used, the foam forming agent can suitably be a compound such as glycerol monostearate and/or glycerol monooleate. Polyglycerol esters can be prepared by polymerizing glycerin under alkaline conditions suitably followed by reacting them with specific fatty acids. Suitable polyglycerol esters can be hexaglycerol monooleate, octaglycerol monostearate and/or octaglycerol monooleate. Sorbitan esters of fatty acids used in certain embodiments of the present invention can be sorbitan monostearate, sorbitan monooleate and/or sorbitan mono palmitate. Furthermore, any possible combinations of compounds belonging to the above mentioned classes can be used.

By choosing suitable amounts of foam forming agent and foam stabilizing agent together with the tobacco ingredient containing agent and/or the inhalable agent can create and stabilize the foam matrix, which can contribute to the hardness of the foam.

Like the foam stabilizing agent, the amount of the foam forming agent is not particularly limited as long as a foam is formed. For example, the foam forming agent can be contained in an amount of 0.5-12 wt.-%, preferably 1-11 wt.-%, more preferably 1.5-10 wt.-%, further preferably 1.8-9.5 wt.-%, further preferably 2-9 wt.-%, even further preferably 2-7 wt.-%, particularly preferably 2.25-6.75 wt.-%, e.g. 3-5.5 wt.-%.

Furthermore, also the aerosol forming agent is not particularly limited, and the foam can comprise also more than one aerosol forming agent, e.g. two, three or four, e.g. in the form of a mixture.

According to certain embodiments, the aerosol forming agent of the present foam is selected from the group consisting of glycerol, glycol derivatives, sebacate esters, and/or mixtures thereof, without being limited thereto. A glycol derivative that can be used in certain embodiments is propylene glycol, and a suitable sebacate ester can be di-2-ethylhexyl sebacate. Furthermore, any possible combinations of compounds belonging to the above mentioned classes can be used. For example, a combination of glycerol and propylene glycol can be used as aerosol forming agent. Preferred examples of the present aerosol forming agent are glycerol, propylene glycol, and mixtures thereof, with glycerol and a mixture of propylene glycol and glycerol further preferred and a mixture of propylene glycol and glycerol even further preferred. According to certain embodiments, at least glycerol is comprised as an aerosol forming agent. According to certain embodiments, the glycerol and propylene glycol can be used with equal weight percent, but also with different weight percent. In certain embodiments, 10-95 wt.-% of glycerol and 5-90 wt.-% of propylene glycol, preferably 10-80 wt.-% of glycerol and 20-90 wt.-% of propylene glycol, further preferably 10-70 wt.-% of glycerol and 70-10 wt.-% of propylene glycol, e.g. 15-65 wt.-% of glycerol and 65-15 wt.-% of propylene glycol, preferably 20-40 wt.-% of glycerol and 10-40 wt.-% of propylene glycol, e.g. 20-40 wt.-% of glycerol and 20-40 wt.-% of propylene glycol can be used as aerosol forming agent, wherein the total mass of the aerosol forming agent is 10 to 80 wt.-%, preferably 40-70 wt.-% of the weight of the foam, so that the two components can be suitably set regarding their ratio. According to certain embodiments, glycerol is used as sole aerosol forming agent, though.

A suitable ratio of propylene glycol and glycerol is, according to certain embodiments, in a mixture comprising these two as aerosol forming agent or consisting of these two as aerosol forming agent, according to preferred embodiments between 8:1 and 1:8, preferably between 80:20 and 20:80, further preferably between 4:1 and 1:4, further preferably between 70:30 and 30:70, even further preferably between 1:2 and 2:1, e.g. between 60:40 and 40:60, e.g. between 55:45 and 45:55, based on a weight ratio. According to certain embodiments, glycerol is used in an excess amount compared to propylene glycol if they are both used as a mixture for an aerosol forming agent or particularly are used as aerosol forming agent. According to certain embodiments, glycerol is used in an amount of at least 55 wt.-%, preferably at least 60 wt.-%, based on the total amount of glycerol and propylene glycol in the aerosol forming agent. Accordingly, according to certain embodiments, propylene glycol is used in an amount of at most 45 wt.-%, preferably 40 wt.-% or less, based on the total amount of glycerol and propylene glycol in the aerosol forming agent. According to certain embodiments, the ratio between glycerol and propylene glycol is between 20:80 and 90:10, preferably between 40:60 and 85:15, further preferably between 55:45 and 80:20, even further preferably between 60:40 and 80:20, e.g. around 60:40, e.g. 60:40, based on the total amount of glycerol and propylene glycol in the aerosol forming agent. The ratio of propylene glycol and glycerol can influence the basic viscosity of the foam. A higher amount of glycerol leads to a higher viscosity and to a better texture of the foam, e.g. a mousse and enables a better release of the tobacco ingredient containing agent and/or the inhalable agent, leading to a better "body" for inhalation due to a better mingling. Further, a higher amount of glycerol can lead to a decreased level of initially created vapor upon heating, which can have an influence on the harshness of the vapor felt upon inhalation. At the same heating temperature, also glycerol can release less vapor volume than propylene glycol if the heating is above the boiling point of both. A higher amount of propylene glycol leads to a sweet top note during inhalation especially if 10 wt.-% or more, preferably 20 wt.-% or more, e.g. 20 to 40 wt.-%, or more than 20 wt.-%, more than 30 wt.-%, or more than 40 wt.-% of the total humectant/aerosol forming agent comprises propylene glycol rather than glycerin.

The aerosol forming agent is comprised in an amount of 10 to 80 wt.-%, preferably 20 to 75 wt.-%, further preferably 40-70 wt.-%, further preferably 45-70 wt.-%, more preferably 45-65 wt.-%, particularly preferably 50-63 wt.-%, more preferably 55 to 65 wt.-%, e.g. about 60 wt.-% of the weight of the foam, which is much higher than in the prior art regarding reconstituted tobacco foams, as an aerosol is to be formed. This can for example enable a more convenient foam manufacturing process than in the prior art. If the amount of aerosol forming agent is too high, though, no foam is formed, but a creamy liquid fluid. If the amount of aerosol forming agent is too low, no foam is formed, but a paste particularly without a foam structure, particularly bubbles and/or pores.

Propylene glycol as used in the present invention is to be understood as propane-1,2-diol. Glycerin or glycerol as used in the present invention is to be understood as 1,2,3-propanetriol.

The aerosol forming agent can further comprise water. According to certain embodiments, no water is contained, though, since water in aerosol form can burn the mouth of a user. Water can be contained in an amount of 0-15 wt.-% of the weight of the foam, e.g. 5-10 wt.-%. Small amounts of water and/or an acid and/or ester, e.g. diacetin, particularly of water and/or ester, e.g. diacetin, up to 5 wt.-%, preferably up to 3.5 wt.-%, further preferably up to 2.5 wt.-%, even further preferably up to 1.5 wt.-%, and most preferably between 0.5-1.5 wt.-%, at least between 0.5-1.5 wt.-% water, can be contained in the foam. According to certain embodiments, no water and/or acid, particularly no water and/or ester, e.g. diacetin, is contained in the present foam. If an ester, e.g. diacetin, is included, it is preferably included with 3 wt.-% or less, preferably 2 wt.-% or less, further preferably 1.5 wt.-% or less, e.g. 1 wt.-% or less.

According to certain embodiments, the present foams can further comprise at least one non-tobacco flavoring agent. In certain embodiments, the flavors can be selected from menthol, natural plant flavors, e.g., cinnamon, sage, herb, chamomile, kudzu (*Pueraria lobata*), *hydrangeae dulcis* folium, clove, lavender, *cardamom, caryophyllus*, nutmeg, bergamot, geranium, honey essence, rose oil, lemon, orange, *cassia* bark, caraway, jasmine, ginger, coriander, vanilla extract, spearmint, peppermint, *cassia*, coffee, celery, cascarilla, sandalwood, cocoa, ylang ylang, fennel, anise, licorice, St John's bread, prune extract, and peach extract; saccharides, e.g., glucose, fructose, isomerized saccharide, and caramel; cocoa, e.g., powder and extract; esters, e.g., isoamyl acetate, linalyl acetate, isoamyl propionate, and linalyl butyrate; ketones, e.g., menthone, ionone, damascenone, and ethyl maltol; alcohols, e.g., geraniol, linalool, anethole, and eugenol; aldehydes, e.g., vanillin, benzaldehyde, and anisaldehyde; lactones, e.g., γ-undecalactone and γ-nonalactone; animal flavors, e.g., musk, ambergris, civet, and castoreum; and hydrocarbons, e.g., limonene and pinene, and combinations thereof, without being limited thereto. Such a flavor or others can be used alone or in combination. The non-tobacco flavoring agent can be e.g. added in an amount so that the total amount of tobacco ingredient containing agent and the non-tobacco flavoring agent, in case these two are comprised, add up to the amounts given for the tobacco ingredient containing agent given above.

In certain embodiments, the foams may comprise an electrically conducting material, and more particularly a ferromagnetic material, to generate heat by induction. The electrically conducting material is not particularly limited and may be any one of, or alloys of, iron, nickel, stainless steel, manganese, silicon, carbon and copper. The electrically conducting material might be in the form of a powder and/or larger particles. The amount thereof is not particularly restricted and can be suitably set.

The present foams can for example be formed into a foam pipe, disc, etc., with optionally one or more tunnels and/or holes for the airflow, and a foam stick, etc. can for example be cut into pod-sized pieces to be placed in a pod.

In another embodiment, the foams can be arranged as a pod, disc, or stick, and may be wrapped in a porous paper, for example with a filter at the tip proximal the user. The porous paper is not particularly limited and may be made of wood pulp and/or hemp fibers or combinations thereof. The filtering material of the filter is not particularly limited and may be any filamentary material conventionally employed for tobacco smoke filter manufacture. The filtering material may be a natural or synthetic filamentary tow, e.g. of cotton or plastics such as polyethylene or polypropylene, or cellulose acetate filamentary tow.

The present foams may be sold in packaging, e.g. a hermitically sealed wrapper, which may for example be removed by the user or perforated by the e-cigarette when operatively housed. Another example can be a blister pack containing one or several foam units, either together or separate, e.g. separated, i.e. in separated packaging units that can be opened separately. According to certain embodiments, the packaging at least prevents water from contacting the present foams.

A peripheral supporting material e.g. metal or other inert material for heat transmission may surround the present foam. In an example of an annular ring foam, the supporting material can be a metal ring arranged e.g. around the side of the annulus. The supporting material may have apertures for circulation.

The present foams can form an aerosol upon being subjected to a temperature of 150-350° C., e.g. 200-300° C., preferably at least above a boiling point of an aerosol forming agent, e.g. to at least the boiling point of the aerosol forming agent with the highest boiling point, but to a temperature below which the foam is combusted. The heat can be supplied by any heat source appropriate, such as an electrical heater or another heat-generating device appropriate, which is not particularly limited. If the temperature is too low, evaporation of the aerosol forming agent in the foam is insufficient, leading to not enough aerosol. If the temperature is too high, there is a risk that the formed aerosol is too hot and that the foam may suffer from combustion.

According to certain embodiments, the foams include a porous structure which is open-pored, particularly wherein the structure is essentially formed from the foam forming agent and the foam stabilizing agent.

According to certain embodiments, the aerosol forming agent and/or the tobacco ingredient containing agent and/or an inhalable agent and/or the optional at least one non-tobacco flavoring agent is at least to some extent adhered to the foam structure and/or absorbed in the foam structure, and particularly the aerosol forming agent and/or the tobacco ingredient containing agent and/or an inhalable agent and/or the optional at least one non-tobacco flavoring agent is essentially adhered to the foam structure and/or absorbed in the foam structure. This way these components can be easily released upon heating, particularly together with the aerosol forming agent.

According to certain embodiments, the present foams further comprise a solvent and/or an acid and/or an ester in an amount of up to 15 wt.-%, based on the total weight of the foam, preferably up to 5 wt.-%, as already discussed above.

According to certain embodiments, the solvent and/or acid and/or ester are comprised in an amount of up to 15 wt.-% prior to any drying stage, based on the total weight of the foam, preferably up to 5 wt.-%. Water can be contained in an amount of 0-15 wt.-% of the weight of the foam prior to any drying stage, e.g. 5-10 wt.-%. Small amounts of water and/or an acid and/or ester, e.g. diacetin, particularly of water and/or ester, e.g. diacetin, up to 5 wt.-%, preferably up to 3.5 wt.-%, further preferably up to 2.5 wt.-%, even further preferably up to 1.5 wt.-%, and most preferably between 0.5-1.5 wt.-%, at least between 0.5-1.5 wt.-% water, can be contained in the foam prior to any drying stage. According to certain embodiments, no water and/or acid, particularly no water and/or ester, e.g. diacetin, is contained in the present foam prior to any drying stage. If an ester, e.g. diacetin, is included, it is preferably included with 3 wt.-% or less, preferably 2 wt.-% or less, further preferably 1.5 wt.-% or less, e.g. 1 wt.-% or less prior to any drying stage.

The present invention further relates to a method of generating an aerosol, the method comprising heating a foam comprising a tobacco flavor containing agent, an aerosol forming agent, a foam stabilizing agent, and a foam forming agent, particularly the foam of the first and/or second and/or third aspect of the invention, in the absence of combustion at 150-350° C., e.g. 200-300° C. A method of generating an aerosol can be, for example, carried out with the foam of the present invention.

In certain embodiments, the present foam may comprise tobacco, optionally nicotine and optionally at least one additional flavor. In certain other embodiments it may comprise nicotine and optionally at least one additional flavor. And in yet another embodiment it may comprise only tobacco flavoring as tobacco ingredient containing agent. And in yet another embodiment it may comprise only at least one inhalable agent and optionally at least one additional flavor.

The present invention further relates to an aerosol obtainable by heating the present foams in the absence of combustion. An absence of combustion herein means heating to a temperature which is below the combustion temperature of the components of the foam, which generate the aerosol, or even below the combustion temperature of all components of the foam. Such a temperature can be e.g. 350° C. or less, for example 150-350° C., e.g. 200-300° C.

The aerosol can be released by heating the foam. The aerosol forming agent can be mingled with the tobacco ingredient containing agent and/or the inhalable agent and optionally one or more additional flavor, and/or extract the tobacco ingredient containing agent and/or the inhalable agent. When the aerosol forming agent is heated and vaporized, the vapor can be carrying the attached tobacco ingredient containing agent and/or the inhalable agent and/or one or more compounds extracted from the tobacco ingredient containing agent and/or the inhalable agent and optionally one or more additional flavors.

Also disclosed is a (first) method of forming a foam, comprising mixing an aerosol forming agent, a foam forming agent and optionally a solvent, which is not particularly limited and can comprise e.g. purified water, an acid and/or ester, e.g. diacetin, and/or an alcohol such as ethanol, 1-propanol and/or 2-propanol, or mixtures thereof, under heating, optionally injecting or swirling in a gas, e.g. during heating, wherein the gas can be for example air, oxygen, nitrogen, or mixtures thereof, adding a tobacco ingredient containing agent and/or the inhalable agent, adding a foam stabilizing agent, and cooling of the mixture.

In addition, disclosed is a (second) method of forming a foam, comprising mixing an aerosol forming agent and optionally a solvent, under heating; adding to the mixture a tobacco ingredient containing agent and/or an inhalable agent; adding a foam forming agent; optionally injecting a gas; adding a foam stabilizing agent; and cooling of the mixture, wherein preferably the foam stabilizing agent is added after the foam forming agent, aerosol forming agent, the optional solvent, and the tobacco ingredient containing agent and/or an inhalable agent.

With the present methods, particularly the foams of the first and/or second and/or third aspect of the invention can be produced. Therefore, the aerosol forming agent, the foam forming agent, the foam stabilizing agent, the tobacco ingredient containing agent and/or the inhalable agent can be chosen as indicated above with regard to the foams of the invention, as well as the amounts of each of these. Also, at least one non-tobacco flavoring agent and/or an electrically conducting material and/or other optional ingredients can be suitably added, as indicated above with regard to the present foams.

According to certain embodiments, the step of mixing an aerosol forming agent, optionally a foam forming agent—in the first method—and optionally a solvent under heating is carried out first. According to certain embodiments, the foam forming agent is therein added to the aerosol forming agent in the first method, particularly when the aerosol forming agent comprises more than one component, e.g. propylene glycol and glycerol. In the second method the foam forming agent is added preferably after the tobacco ingredient containing agent and/or inhalable agent, particularly when the tobacco ingredient containing agent and/or inhalable agent can be dissolved in the aerosol forming agent and the optional solvent and/or when they do not bind to the foam structure, i.e. are only adhered/adsorbed thereto and/or absorbed therein. When the foam forming agent is added the viscosity can be increased, and a bubbly microstructure, e.g. in the presence of air an airy microstructure, can be formed, which enables a constant release of aerosol from the foam upon heating as well as a release of a consistent vapor volume. In the second method then also the tobacco ingredient containing agent and/or inhalable agent can then be contained in the microstructure and efficiently released upon heating, leading to a constant vapor stream and stable flavor perception.

In the first method the tobacco ingredient containing agent and/or inhalable agent are preferably added after the foam forming agent. In this case the tobacco ingredient containing agent and/or inhalable agent can be equally distributed and enables a constant release of flavor and stable perception of flavor. This method is particularly suitable if the tobacco ingredient containing agent and/or inhalable agent is at least partly participating in formation of the foam.

In certain embodiments the mixture can be heated to 30-80° C., e.g. to 45-75° C. when mixing an aerosol forming agent, a foam forming agent and optionally a solvent. The heating can for example aid dispersion, e.g. by lowering viscosity.

If water and/or an acid and/or ester, e.g. diacetin, are added as solvent and/or additive, they preferably are added in an amount of up to 5 wt.-%, preferably up to 3.5 wt.-%, further preferably up to 2.5 wt.-%, even further preferably up to 1.5 wt.-%, based on the weight of the resulting foam. This enables better handling and particularly also makes drying easier and, according to certain embodiments, even unnecessary. If an ester, e.g. diacetin, is added, it is preferably included with 3 wt.-% or less, preferably 2 wt.-% or less, further preferably 1.5 wt.-% or less, e.g. 1 wt.-% or less, e.g. less than 1 wt.-%.

According to certain embodiments, the foam stabilizing agent is added last, i.e. after the aerosol forming agent, the foam forming agent, the tobacco ingredient containing agent and/or the inhalable agent, the optional solvent, and further optional ingredients. The optional solvent, and further optional ingredients can be added in a suitable step, e.g. together with the tobacco ingredient containing agent and/or the inhalable agent.

The final addition of the foam stabilizing agent leads to a stable formation of the foam matrix. This enables a suitable release of aerosol forming agent and flavor, thus enabling a better handling and particularly keeping volatiles in the foam matrix. During heating, at least the foam forming agent and foam stabilizing agent remain as a—disposable—shell after foam formation and evaporation of aerosol forming agent and at least aromas and/or flavors of the tobacco ingredient containing agent and/or the inhalable agent.

In certain embodiments the mixture can be cooled to room temperature and further below, for example 15-25° C., e.g. about 20° C., or below, e.g. to less than 20° C. or even less than 10° C., e.g. in a rapid fashion, e.g. in less than 20 minutes, e.g. 15 minutes or less, e.g. 10 minutes or less. According to certain embodiments, the foam can be aged for 4-24 hours, e.g. 12-24, or e.g. 6-8 hours, and/or at a temperature of 35-60° C., e.g. 40-55° C. The mixing and addition of components in this method are not particularly limited and can be suitably carried out by known methods. In certain embodiments the steps in the method of forming a foam can be performed in the order as indicated above for the respective method. With the present methods, particularly the foam of the present invention can be obtained as well. Thus, according to certain embodiments, the different compounds can be added suitably in such an amount that the present foam is obtained. The corresponding amounts are mentioned already with regard to the present foam.

The present invention further relates to an aerosol generation system, comprising the present foam and an aerosol generation apparatus, e.g. the foam as defined above. In the aerosol generation system, the aerosol generation apparatus is not particularly limited. In certain embodiments, the aerosol generation apparatus can be any kind of e-cigarette or similar devices like an electronic pipe. It can for example comprise a heating system, which is not particularly limited and can be an electrically heated system or an induction heating system, a control system for controlling the heating system, a receiving portion to receive the foam and to convey heat to the foam, without combustion of the foam, and a flow path through the inhalation device to transmit aerosol from the receiving portion, e.g. a pod, e.g. a stick, to the user.

Furthermore, the use of the present foam in an aerosol generation apparatus as described above is disclosed, preferably in a non-burning application, i.e. wherein the foam is not combusted.

In addition, the present invention further provides a method of supplying a foam, particularly according to the first and/or second and/or third aspect of the invention, to an aerosol generation apparatus as described above, the method comprising: removably providing a foam to a receiving portion of the apparatus, the receiving portion operatively connected to a heating system for generation of an aerosol from said foam. In certain embodiments, the present foam is provided to the receiving portion of the apparatus.

Additionally disclosed is a kit for supplying a tobacco ingredient containing agent and/or an inhalable agent containing foam, comprising a foam comprising a foam stabilizing agent, a foam forming agent, and optionally a first aerosol forming agent; and a mixture containing a tobacco ingredient containing agent and/or an inhalable agent, and a second aerosol forming agent, wherein the weight of the tobacco ingredient containing agent and/or the inhalable agent is 0.1-33 wt.-% of the weight of the foam and the mixture, and the total weight of the first and second aerosol forming agent in the kit is 10-80 wt. %, preferably 40-70 wt.-%, of the weight of the foam and the mixture.

The present kit thus at least comprises two components, i.e. the foam and the mixture. Also more than one mixture containing a tobacco ingredient containing agent and/or inhalable agent and a second (or third, fourth, etc.) aerosol forming agent can be contained, e.g. if a kit is to be provided wherein foams with different tastes and/or aromas can be prepared. If more than one mixture is provided, the tobacco ingredient containing agent and/or inhalable agent and the (second) aerosol forming agent can be the same or different. With the present kit foams in line with the first and aspect of the invention also can be prepared. Therefore, the foam stabilizing agent, the foam forming agent, and the tobacco ingredient containing agent and/or an inhalable agent, as well the amounts thereof, can be the same as discussed with regard to the foams of the first and second and third aspect of the present invention. Also the first and second aerosol forming agents and their amounts can be the same as discussed with regard to the foams of the first and second and third aspect of the present invention. The first and second aerosol forming agents can be the same or different. According to certain embodiments, the tobacco ingredient containing agent and/or the inhalable agent are adhered to an outside surface of the foam in the kit when the mixture is applied to the foam, while the microstructure of the foam, e.g. bubbles and/or pores, does not necessary have to contain the tobacco ingredient containing agent and/or the inhalable agent, although this is also not excluded. As in the first and second and third aspect, water and/or an acid and/or ester, e.g. diacetin, as well as other optional components, as given above, can be contained in the foam and/or the mixture of the kit.

In the present kit, the foam and the mixture can be provided in a suitable packaging each, which are not particularly restricted and can be the same as discussed with regard to the foam of the first and second and third aspect of the invention, or can be different. For example, the mixture can also be provided in a suitable applicator to be applied to the foam.

Additionally disclosed is a foam (also called blank foam) comprising a foam stabilizing agent, a foam forming agent, and an aerosol forming agent, wherein the weight of the aerosol forming agent in the foam is 10-80 wt. %, preferably 40-70 wt.-%, of the weight of the foam. This foam represents, according to certain embodiments, a foam as described similarly with regard to the present kit, as well as a foam of the first and/or second and/or third aspect without the tobacco ingredient containing agent and/or the inhalable agent. Thus, again the foam stabilizing agent and the foam forming agent, as well as the aerosol forming agent and the amounts of each can be set as with regard to the first and second and third aspect of the invention. Such a foam can serve as a "blank" foam in the present kit, i.e. for adding suitable flavors and/or aromas. Also, water and/or an acid and/or ester, e.g. diacetin, particularly water and/or ester, e.g. diacetin, as well as other optional components, as given above, ca be contained in this "blank" foam. According to certain embodiments, the "blank" foam consists essentially of the foam stabilizing agent, the foam forming agent, and the aerosol forming agent. According to certain embodiments, the "blank" foam consists of the foam stabilizing agent, the foam forming agent, and the aerosol forming agent.

The "blank" foam can be prepared by the same steps as described in the present methods, except that the addition step of the tobacco ingredient containing agent and/or the inhalable agent is missing.

Therefore, disclosed is a (third) method of forming a foam, comprising mixing an aerosol forming agent, a foam forming agent and optionally a solvent, which is not particularly limited and can comprise e.g. purified water, an acid and/or ester, e.g. diacetin, and/or an alcohol such as ethanol, 1-propanol and/or 2-propanol, or mixtures thereof, under heating, optionally injecting or swirling in a gas, e.g. during heating, wherein the gas can be for example air, oxygen, nitrogen, or mixtures thereof, adding a foam stabilizing agent, and cooling of the mixture.

In addition, disclosed is a (fourth) method of forming a foam, comprising mixing an aerosol forming agent and optionally a solvent, under heating; adding a foam forming agent; optionally injecting a gas; adding a foam stabilizing agent; and cooling of the mixture. The steps can thereby be carried out with the ingredients and amounts thereof and in the order discussed with regard to the first and second method.

Further disclosed is a packaging, containing the foam of the first, second and/or third aspect and/or the blank foam discussed above. According to certain embodiments, the foam of the first, second and/or third aspect and/or the blank foam is sealed in the packaging, particularly sealed in a way to avoid intake of water and/or water vapor. The seal is not particularly restricted in this regard, and the packaging can be e.g. a blister package with aluminium lining, or something similar, as e.g. known from pharmaceutical packaging.

According to certain embodiments, the packaging prevents an uptake of water at a temperature between −20 and +40° C. and at a relative humidity of between 20 and 80% of more than 1 wt. %, based on the weight of the foam, within a period of one year, based on the weight of the foam. According to certain embodiment, a water uptake of more than 1 wt. %, based on the weight of the foam, is prevented in at least 90% of inhabited locations on earth, preferably in at least 90% of locations on earth.

The above embodiments can be combined arbitrarily, if appropriate. Further possible embodiments and implementations of the invention comprise also combinations of features not explicitly mentioned in the foregoing or in the following with regard to the examples of the invention. Particularly, a person skilled in the art will also add individual aspects as improvements or additions to the respective basic form of the invention.

EXAMPLES

The present invention will now be described in detail with reference to examples thereof. However, these examples are illustrative and do not limit the scope of the invention.

TABLE 1

Components used in the present examples 1 to 3.

| Tobacco Mousse (TM) Compounds | Example 1 | Example 2 | Example 3 |
|---|---|---|---|
| Propylene glycol | 26.50 wt.-% | 24 wt.-% | 24.3 wt.-% |
| Glycerin | 32.50 wt.-% | 24 wt.-% | 36.5 wt.-% |
| Purified Water | 2.50 wt.-% | 2 wt.-% | 1.5 wt.-% |
| Tobacco Powder | 23. 50 wt.-% | 5 wt.-% | 13.7 wt.-% |
| Gellan Gum food grade | 3.80 wt.-% | 1 wt.-% | 3.8 wt.-% |
| Cekol ® 2000 | 11.20 wt.-% | 44 wt.-% | 20.2 wt.-% |
| Total | 100.00 wt.-% | 100.00 wt.-% | 100.00 wt.-% |

Example 1

Table 1 shows components used for producing an exemplary embodiment of the present foam.

For producing the exemplary foam, the ingredients given in the respective column of Table 1 were mixed and combined as follows.

First, the propylene glycol and the glycerin were mixed and shaken, followed by mixing in purified water and shaking again. Next, the gellan gum was added and the mixture was shaken again. The whole mixture was then heated to about 70° C. for 5 minutes to start bubble formation. After adding the tobacco powder over the course of 5 minutes, the mixture was homogenized for another 10 minutes. The Cekol® 2000 was added over the course of 5 minutes as well, followed by mixing for another 10 minutes. Afterwards, the mixture was cooled to 10° C. within 10 minutes and aged at 50° C. for 8 hours.

The foam obtained in this way was shaped as a pipe/stick with a tunnel formed within and cut in smaller portions used in a test for determining the smoking profile thereof.

FIG. 1 shows the smoking profile obtained in this test, i.e. of a vapour mousse comprising the present foam. In FIG. 1 the lower line indicates the total particle matter (TPM) per puff in mg, indicated on the left hand side of the figure and the upper line shows the taste intensity, wherein the first puff is set to a taste intensity of 100%, indicated on the right hand side of the figure. The taste intensity and TPM can be kept at almost the same level for a large number of puffs, before declining rather rapidly. This indicates a very efficient extraction of volatiles when heated. The TPM can be kept consistent for up to 30 puffs, which corresponds to a constant delivery, followed by a sharp decrease in TPM as the product is substantially extracted from the foam. A significant factor behind the consistent delivery can be the open pored structure of the foam.

Example 2

Example 2 was prepared as described in Example 1, using the appropriate amounts for the components, as given in Table 1 in the respective column.

Example 3

Example 3 was prepared as described in Example 1, using the appropriate amounts for the components, as given in Table 1 in the respective column.

Example 4

Example 4 was prepared as described in Example 2, except that the tobacco powder was replaced by menthol.

Examples 5 to 9

Examples 5 to 9 were prepared as described in Example 1, with the amount given in Table 2.

TABLE 2

Components used in the present examples 5 to 9

| Tobacco Mousse (TM) Compounds | Example 5 | Example 6 | Example 7 | Example 8 | Example 9 |
|---|---|---|---|---|---|
| Aerosol forming agent (60:40 mixture (wt./wt.) of glycerin and propylene glycol) | 40 wt.-% | 70 wt.-% | 50 wt.-% | 60 wt.-% | 80 wt.-% |
| Tobacco powder | 33 wt.-% | 16.5 wt.-% | 27.5 wt.-% | 22 wt.-% | 11 wt.-% |
| Gellan Gum food grade | 6.75 wt.-% | 3.375 wt.-% | 5.625 wt.-% | 4.5 wt.-% | 2.25 wt.-% |
| Cekol ® 2000 | 16.5 wt.-% | 8.25 wt.-% | 13.75 wt.-% | 11 wt.-% | 5.5 wt.-% |
| Purified water | remainder | remainder | remainder | remainder | remainder |
| Total | 100.00 wt.-% | 100.00 wt.-% | 100.00 wt.-% | 100.00 wt.-% | 100.00 wt.-% |

Examples 10 and 11

Example 10 was carried out as Example 5, except that the amount of water was reduced to 0.5 wt.-%, wherein the amount of aerosol forming agent was increased accordingly.

Example 11 was carried out as Example 5, except that the amount of water was increased to 5.0 wt.-%, wherein the amount of aerosol forming agent was decreased accordingly.

Example 12

Example 12 was carried out as Example 5, except that the tobacco powder which had particles with a size <30 μm was replaced by a mixture of tow tobacco powders, one of which was the tobacco powder which had particles with a size <30 μm (80 wt. %, based on the total weight of the tobacco powder), and one of which was a tobacco powder with particles with a size of about 250 μm (20 wt. %, based on the total weight of the tobacco powder). After formation of the foam, both were included in an e-cigarette with a suitable pod for receiving the foam (which was cut to a suitable size), and heated to about 200° C. The generated aerosol was inhaled by a panel of 5 individuals and compared to a aerosol that was obtained by heating the foam of Example 5 in the same way. Overall, the aerosol of Example 12 was considered less harsh.

Examples 13 and 14

Examples 13 and 14 were carried out as Example 8, except that the tobacco powder was replaced by menthol (Example 13) and fruity Logic e-liquid (Example 14), respectively.

Example 15

Example 15 was carried out as Example 5, except that no tobacco particles were added and the amount of foam components was adjusted accordingly.

Example 16

For testing the performance of different foams of the invention, different lots were prepared with systematic changes of components therein, prepared into a cylinder with a central hole, and offered to a test panel of 7 people that were testing the aroma and taste thereof upon vaporization.

The composition of the different lots is given in the following table 3, with the weights given with regard to the total composition.

TABLE 3

Components used in Example 16

| Lot No. | Aerosol forming agent (wt.-%) | Ratio of components of aerosol forming agent (wt.:wt.) *1 | Tobacco powder (wt.-%) | Non-tobacco component (wt.-%) | Cekol ® 2000 (wt.-%) | Gellan Gum food grade (wt.-%) | Purified water (wt.-%) | Diacetin (wt.-%) |
|---|---|---|---|---|---|---|---|---|
| 1 | 40 | 60% G:40% PG | 33 (100% <30 μm) | — | 16.5 | 6.75 | 3.75 | — |
| 1.1 | 60 | 40% G:60% PG | 21 (100% <30 μm) | — | 11 | 4.5 | 2.5 | 1 |
| 1.2 | 70 | 60% G:40% PG | 16.5 (100% <30 μm) | — | 8.25 | 3.375 | 1.875 | — |
| 2 | 50 | 60% G:40% PG | 27.5 (100% <30 μm) | — | 13.75 | 5.625 | 3.125 | — |
| 3 | 60 | 60% G:40% PG | 21 (100% <30 μm) | — | 11 | 4.5 | 2.5 | 1 |
| 3.1 | 60 | 60% G:40% PG | 24.5 (100% <30 μm) | — | 11 | 4.5 | — | — |
| 4 | 60 | 70% G:30% PG | 21 (100% <30 μm) | — | 11 | 4.5 | 2.5 | 1 |
| 5 | 60 | 80% G:20% PG | 21 (100% <30 μm) | — | 11 | 4.5 | 2.5 | 1 |
| 5.1 | 80 | 60% G:40% PG | 11 (100% <30 μm) | — | 5.5 | 2.25 | 12.5 | — |
| 7 | 60 | 100% G | 21 (100% <30 μm) | — | 11 | 4.5 | 2.5 | 1 |
| 8 | 62 | 60% G:40% PG | 21 (100% <30 μm) | — | 11 | 4.5 | 0.5 | 1 |
| 9 | 57.5 | 60% G:40% PG | 21 (100% <30 μm) | — | 11 | 4.5 | 5 | 1 |
| 10 | 62.5 | 60% G:40% PG | 21 (100% <30 μm) | — | 11 | 4.5 | 0 | 1 |
| 11 *2 | 60 | 60% G:40% PG | 21 (100% <30 μm) | — | 11 | 4.5 | 2.5 | 1 |
| 12 *3 | 60 | 60% G:40% PG | 21 (100% <30 μm) | — | 11 | 4.5 | 2.5 | 1 |
| 13 | 60 | 60% G:40% PG | 21 (80% <30 μm, 20% ~250 μm) | — | 11 | 4.5 | 2.5 | 1 |
| 14 | 60 | 60% G:40% PG | 21 (20% <30 μm, 80% ~250 μm) | — | 11 | 4.5 | 2.5 | 1 |

TABLE 3-continued

Components used in Example 16

| Lot No. | Aerosol forming agent (wt.-%) | Ratio of components of aerosol forming agent (wt.:wt.) *1 | Tobacco powder (wt.-%) | Non-tobacco component (wt.-%) | Cekol ® 2000 (wt.-%) | Gellan Gum food grade (wt.-%) | Purified water (wt.-%) | Diacetin (wt.-%) |
|---|---|---|---|---|---|---|---|---|
| 15 | 60 | 60% G:40% PG | 21 (100% ~250 μm) | — | 11 | 4.5 | 2.5 | 1 |
| 16 | *4 | *4 | — | *4 | 32 | 11 | — | — |
| 17 | 40 | 60% G:40% PG | — | — | 52 | 4.5 | 2.5 | 1 |
| 17.1 | 20 | 60% G:40% PG | — | — | 72 | 4.5 | 2.5 | 1 |

*1 based on total weight of aerosol forming agent of glycerin G and propylene glycol PG
*2 mixing time for each step −50%
*3 mixing time for each step +50%
*4: E-liquid comprising PG, VG, nicotine and flavor For preparing the lots in the presence of air, first the aerosol forming agent was prepared by mixing under heating, unless it was pure, and water and optionally diacetin were added and mixed in. Afterwards, the tobacco powder was added, and again mixed. Thereafter, the gellan gum as foam forming agent was added, and again mixed. Thereafter, the foam stabilizing agent Cekol® 2000 was added, and the mixture cooled.

The foam was prepared into the shape given above and used for testing in the panel test.

Exemplary results are given in FIGS. 2 to 8, wherein different lots are compared regarding taste characteristics.

Figure 2:
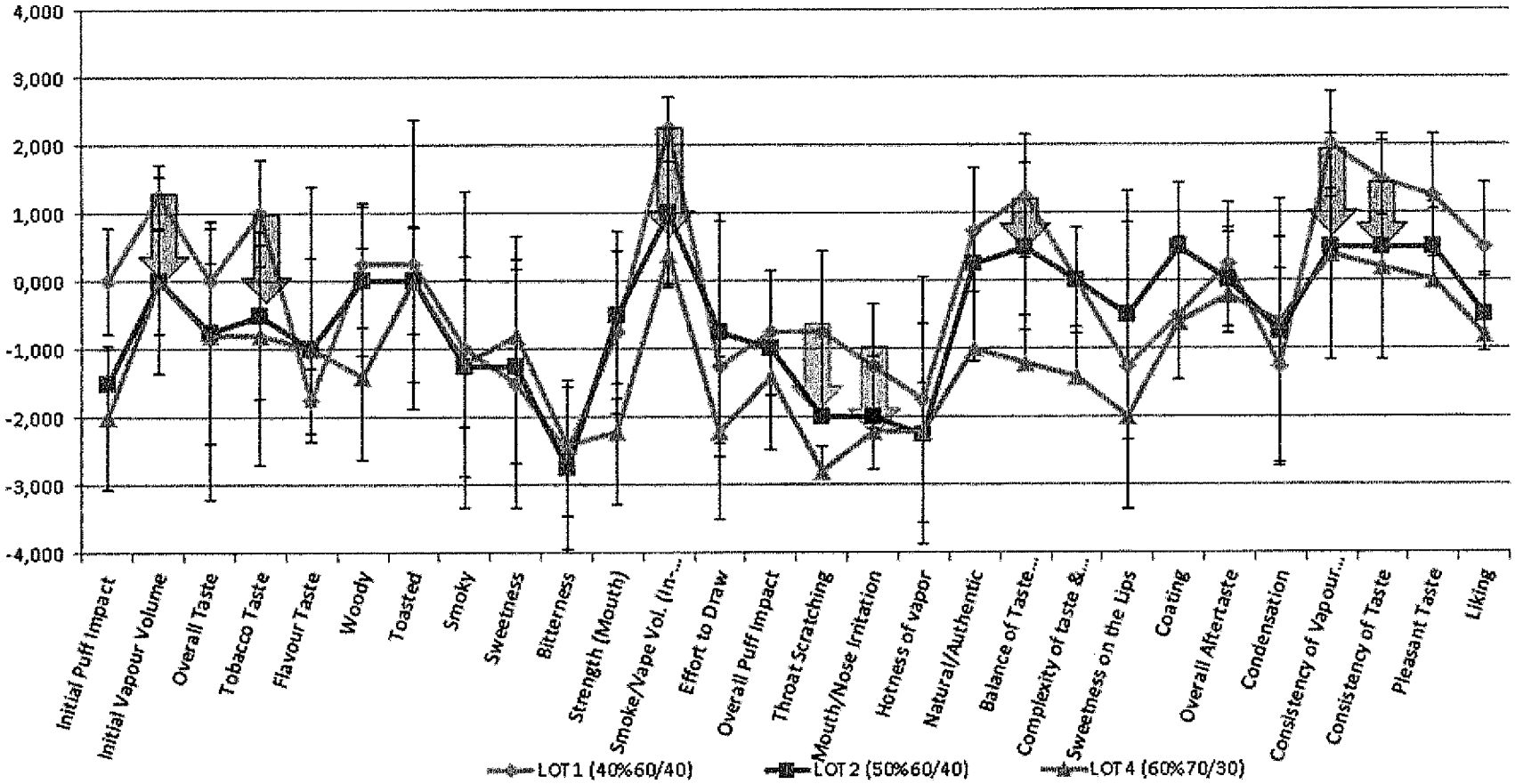
FIGS. 2 to 8 show results obtained in present Example 16.
Figure 3:
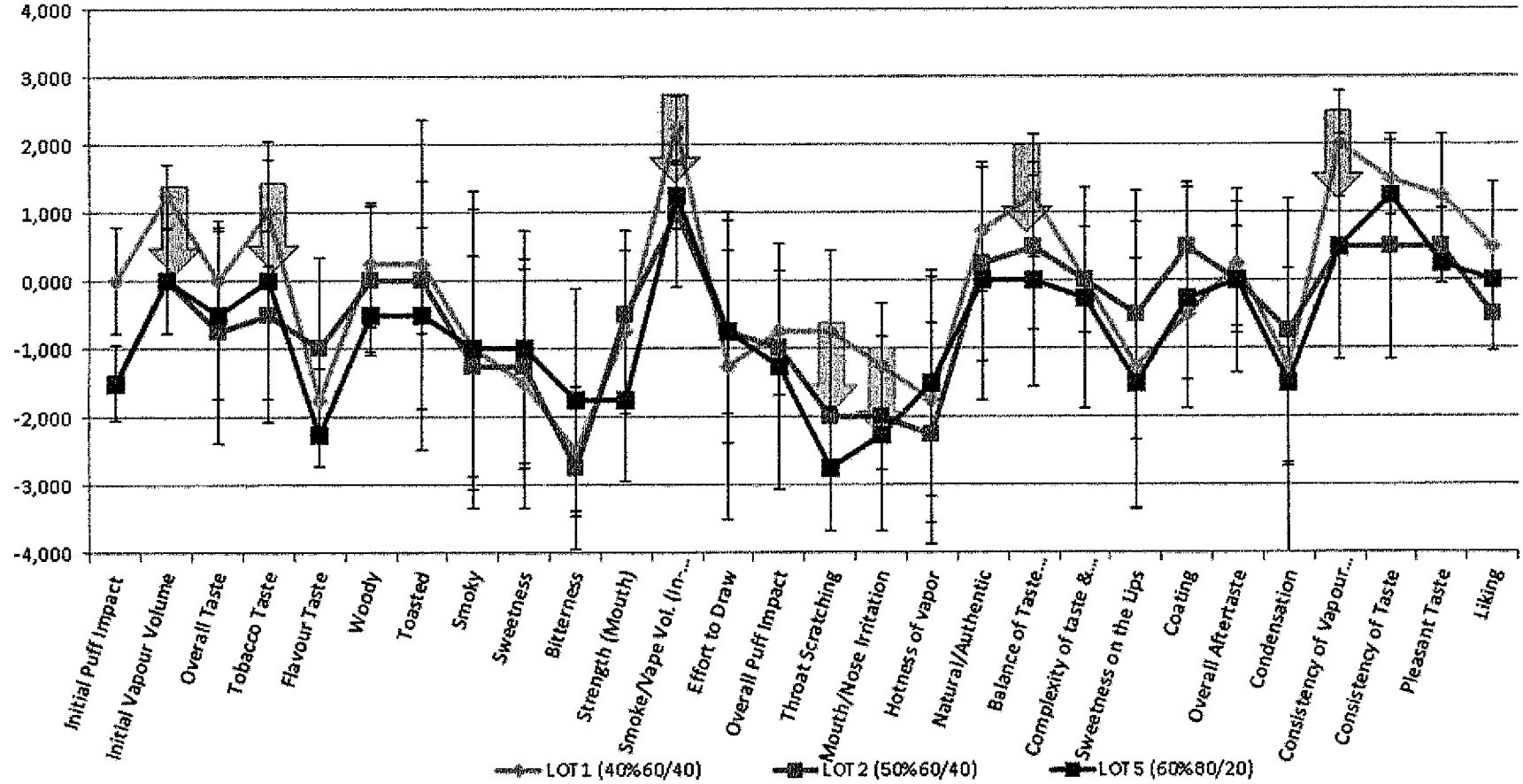
Figure 4:
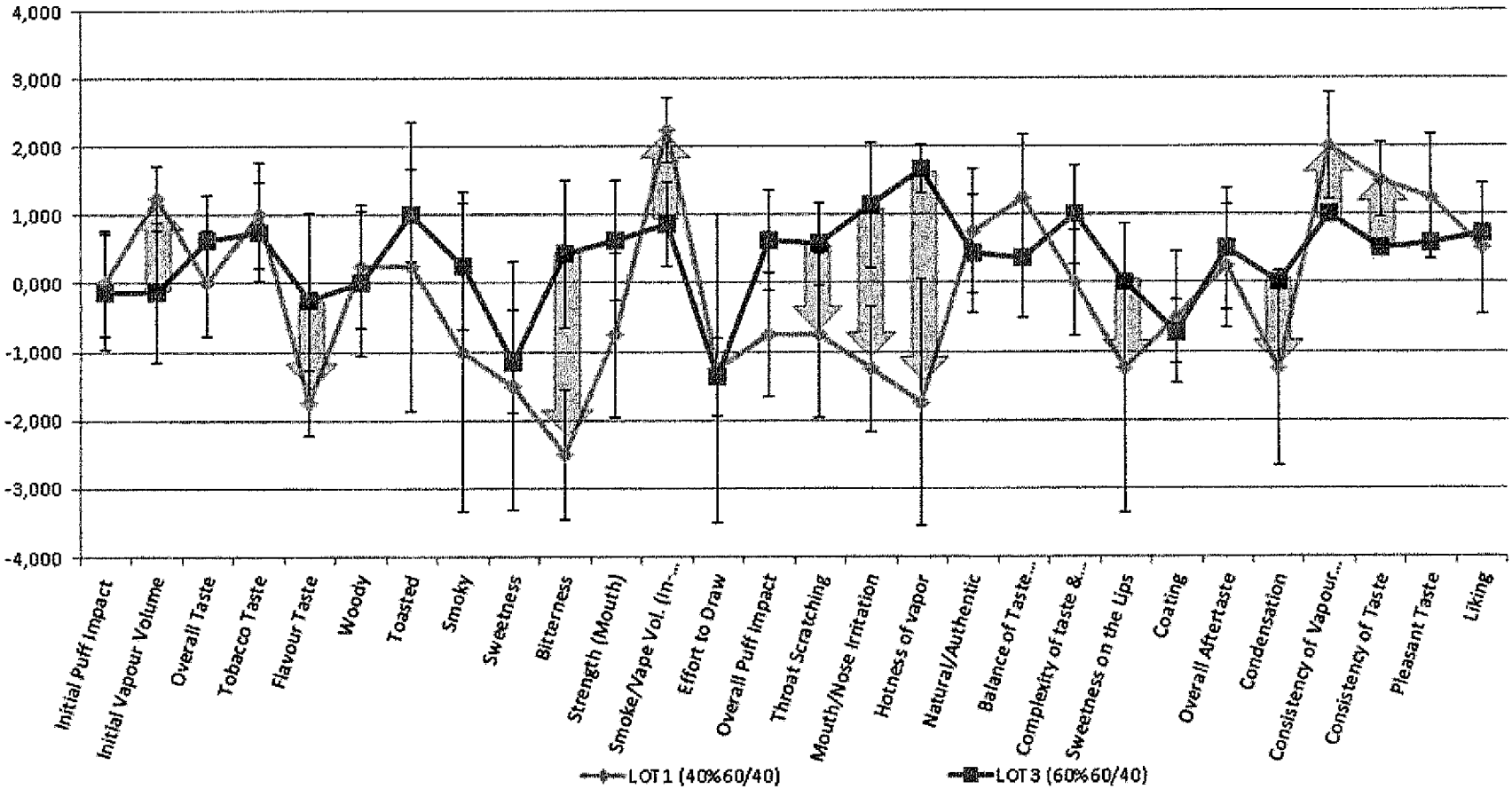
Figure 5:
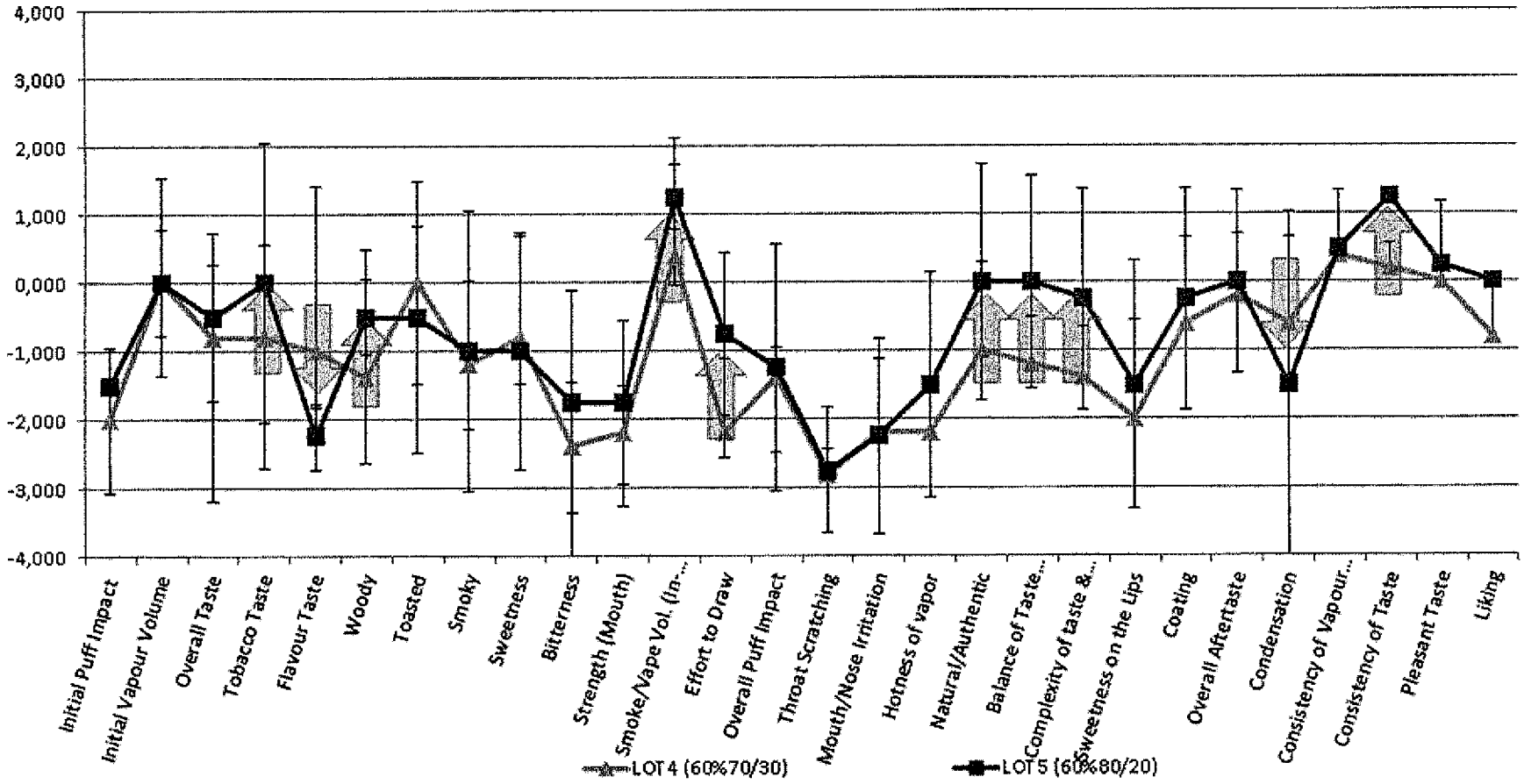
Figure 6:
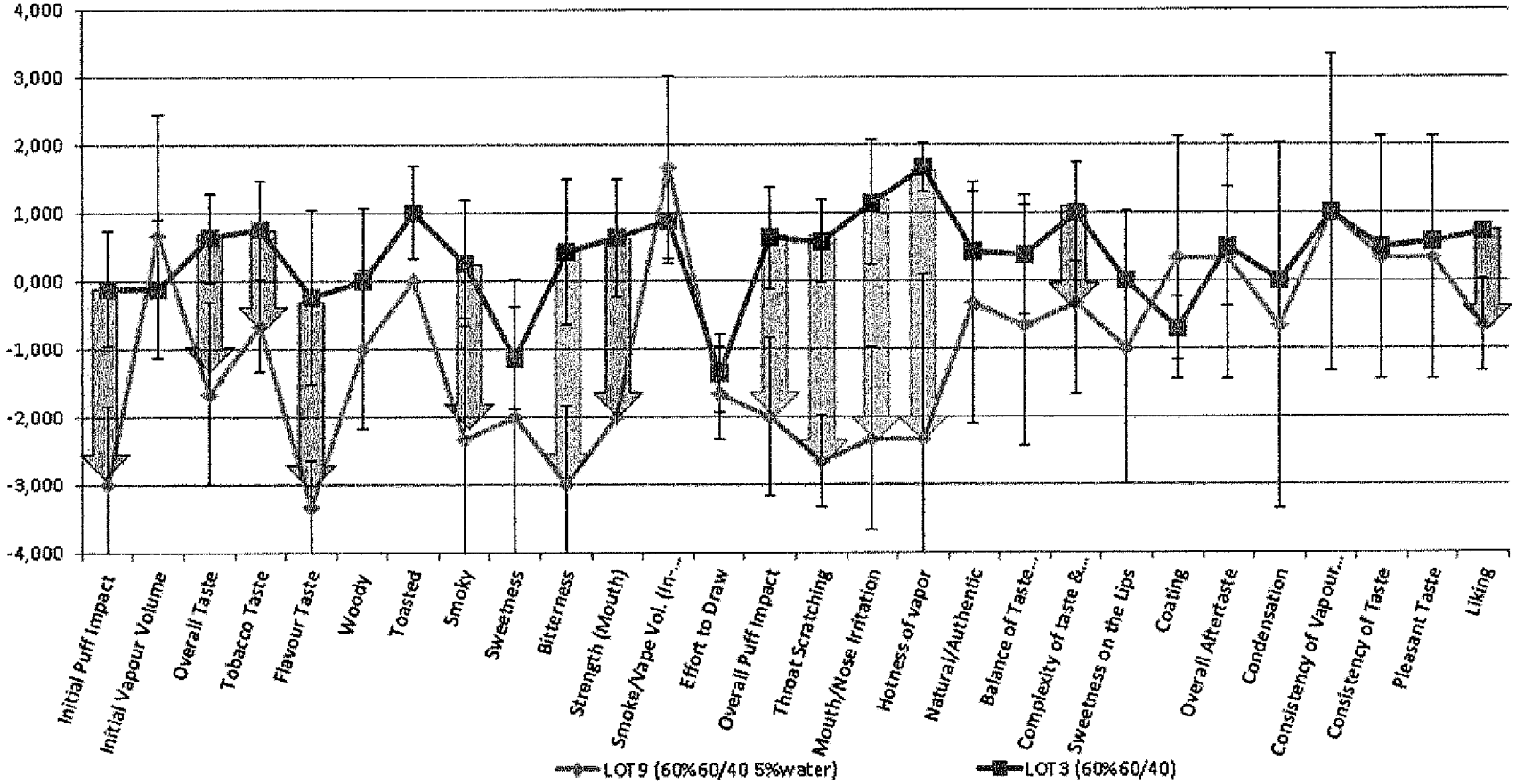
Figure 7:
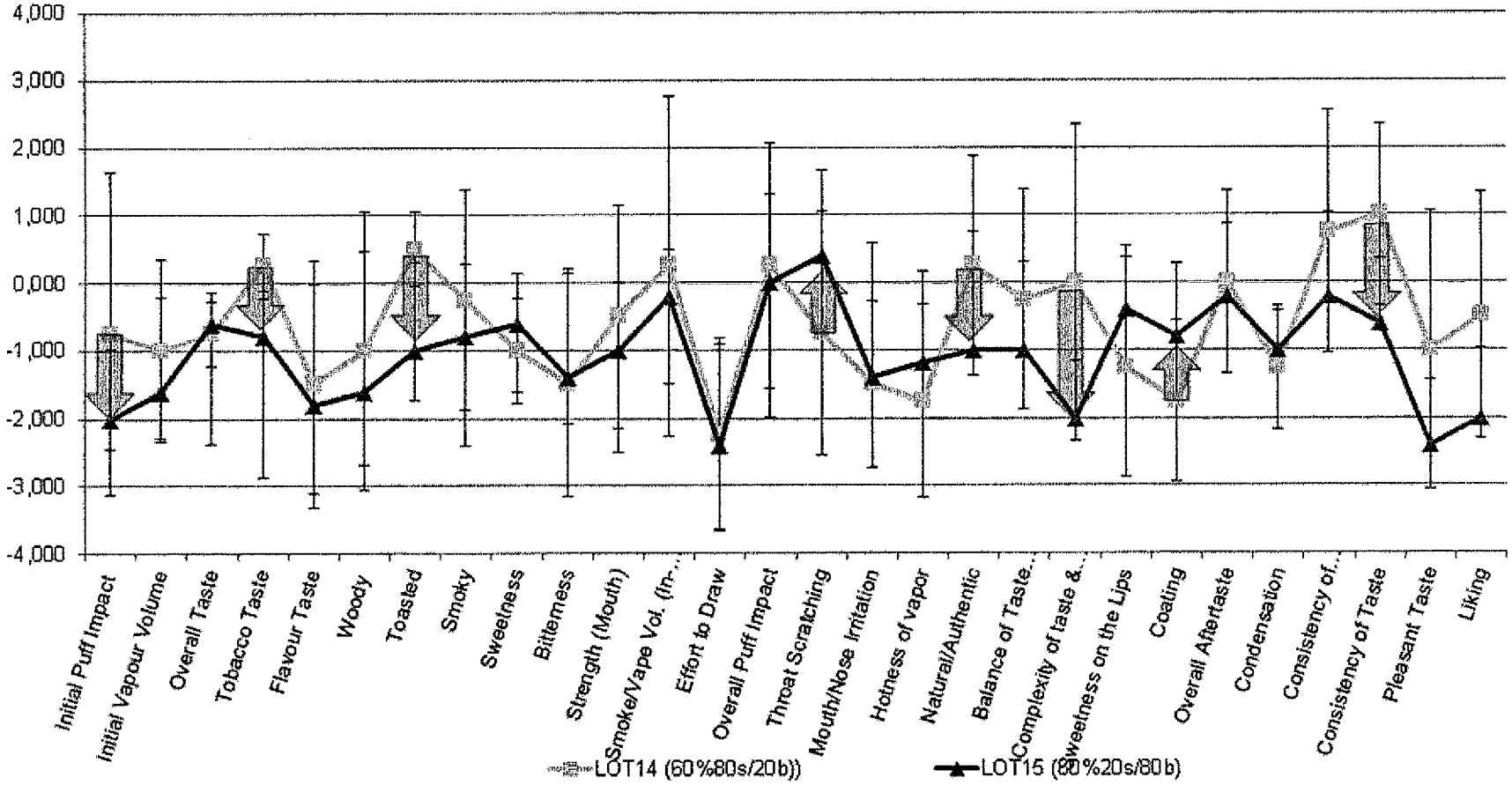
Figure 8:
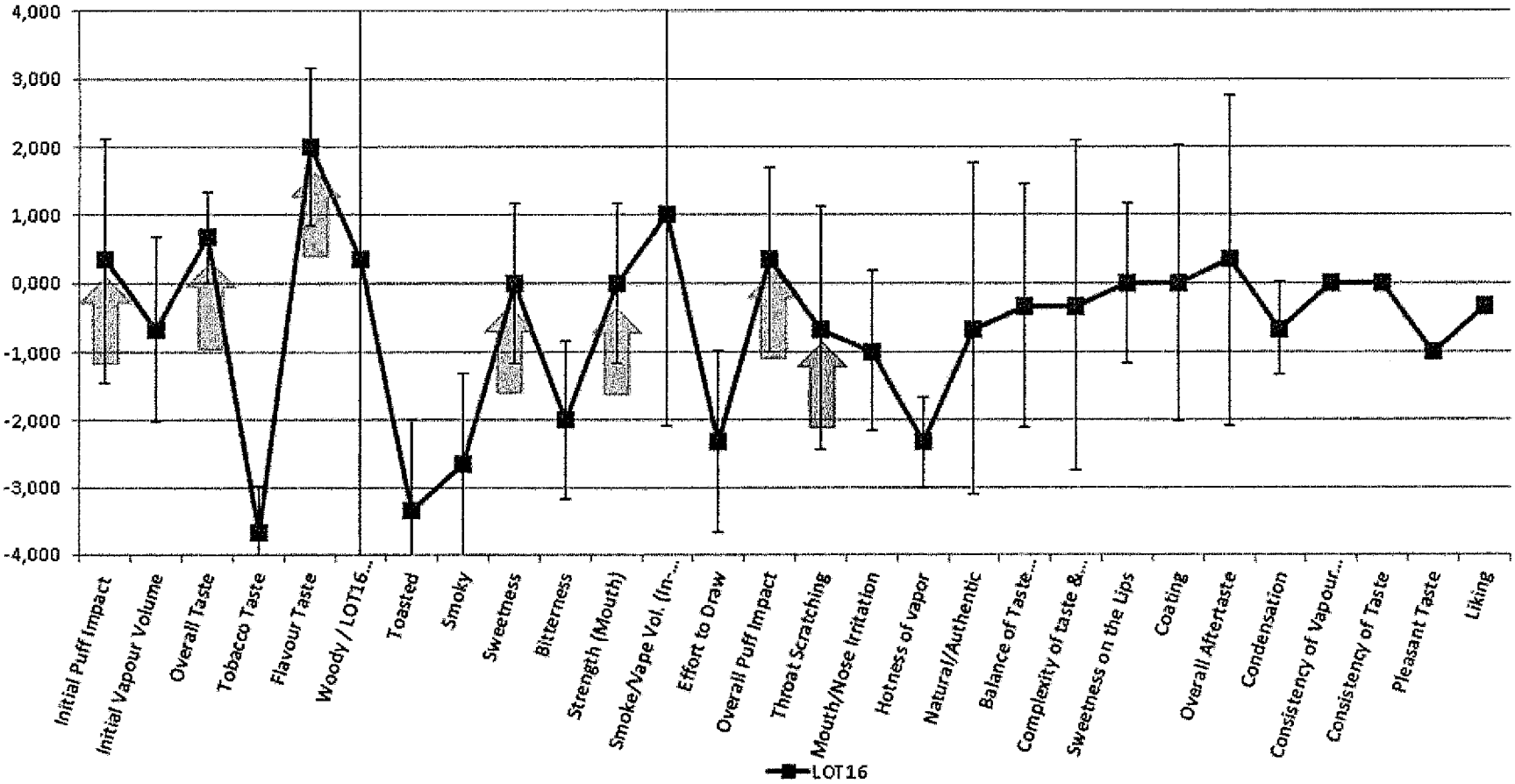

In FIG. 2 lots 1, 2 and 4 are compared, in FIG. 3 lots 1, 2 and 5, in FIG. 4 lots 3 and 1, in FIG. 5 lots 4 and 5, in FIG. 6 lots 9 and 3, in FIG. 7 lots 14 and 15, and FIG. 8 shows the result obtained with lot 16.

The lots were described in average by the panels as follows:

Lot 1: good tobacco character and sweetness, consistent taste, low throat scratch, easy to inhale, good balance, low negatives, burley after taste, good vapor volume from first puff Lot 2: weaker overall taste, low harshness and low throat scratch, easily smoked, LOT1 better, bitterness after ten puffs, too sweet condensation and on lips artificial sweetness, lingering on tongue, toasted, taste strength between LOT3 and LOT7, overall flatter, smooth, some tongue prickling Lot 4: good tobacco taste, easily inhaled, lower flavour and lower tobacco taste, less smoky/roasted, more sweet, less condensation, weak taste, smooth Lot 5: more smokey tobacco taste, toasted direction, pleasant sweetness, easy to inhale, low throat scratch, acceptable condensation, vapour volume fine, smooth, toasty, good level of bitterness Lot 14: pleasant aftertaste, very high impact from first puff till end, dry, harsh, strong tobacco taste but simple, flat taste in the beginning and getting stronger puff by puff, bitter increase, throat scratching Lot 15: very bitter, low vapor volume until 6 puffs, after 6 puff high vapor volume, increasing throat scratch, dry, less vapor volume, condensate higher Lot 16: fresh minty/menthol taste, strawberry vanilla character, taste decreases over time and becomes quite neutral, overall taste acceptable, berry-mint character, very fresh flowery, condensate and sweet lips, roasty note towards the end, later puffs have strong impact, fresh aftertaste, high freshness, some fruity flavour note (maybe strawberry), high in impact, strong menthol bitter, vapor volume good after 4 puffs

The invention claimed is:

1. A method of forming a foam, comprising:

mixing an aerosol forming agent and gellan gum under heating;

adding to the mixture a tobacco ingredient containing agent and/or an inhalable agent;

adding to the mixture a foam stabilizing agent; and cooling the mixture.

2. The method of claim 1, wherein the step of mixing includes mixing the aerosol forming agent, the gellan gum, and a solvent under heating.

3. The method of claim 1, further comprising injecting a gas to the mixture after the step of mixing and before the steps of adding and cooling.

4. The method of claim 1, wherein the step of adding to the mixture the foam stabilizing agent is performed after the step of adding to the mixture the tobacco ingredient containing agent and/or the inhalable agent.

5. A method of forming a foam, comprising:

mixing an aerosol forming agent and a solvent under heating;

adding to the mixture a tobacco ingredient containing agent and/or an inhalable agent;

adding to the mixture gellan gum;

adding to the mixture a foam stabilizing agent; and cooling of the mixture.

6. The method of claim 5, further comprising injecting a gas to the mixture after the steps of mixing, adding to the mixture the tobacco ingredient containing agent and/or the inhalable agent, and adding to the mixture the gellan gum.

7. The method of claim 5, wherein the step of adding to the mixture the foam stabilizing agent is performed after the steps of adding to the mixture the tobacco ingredient containing agent and/or the inhalable agent and adding to the mixture the gellan gum.

* * * * *